US006116989A

United States Patent [19]

Balastik

[11] Patent Number: 6,116,989

[45] Date of Patent: Sep. 12, 2000

[54] APPARATUS FOR DRESSING A GRINDING DISC

[76] Inventor: George Jiri Balastik, 512-225 Alvin Road, Ottawa, Ont., Canada, K1K 4H6

[21] Appl. No.: 09/224,966

[22] Filed: Jan. 4, 1999

[30] Foreign Application Priority Data

Jan. 16, 1998 [CS] Czechoslovakia ..... PUV 7575-98

[51] Int. Cl.[7] ..... B24B 7/00; B24B 9/00

[52] U.S. Cl. ..... 451/72; 451/443; 125/11.01

[58] Field of Search ..... 451/37, 56, 72, 451/229, 234, 293, 371, 383, 405, 443; 125/11.01, 11.03

[56] References Cited

U.S. PATENT DOCUMENTS

| | | | |
|---|---|---|---|
| 2,640,477 | 6/1953 | Norlander | 125/11 |
| 3,517,659 | 6/1970 | Stewart et al. | 125/11 |
| 3,938,492 | 2/1976 | Mercer, Jr. | 125/11 R |
| 4,448,184 | 5/1984 | Zmiewski | 125/11 B |
| 4,903,553 | 2/1990 | Shepherd | 76/37 |
| 4,907,370 | 3/1990 | Tabata et al. | 51/5 |
| 5,117,588 | 6/1992 | Osborn et al. | 51/5 D |
| 5,441,449 | 8/1995 | Hart | 451/72 |
| 5,591,069 | 1/1997 | Wurthman | 451/241 |

FOREIGN PATENT DOCUMENTS

| | | |
|---|---|---|
| 1118514 | 2/1982 | Canada . |
| 1315990 | 4/1993 | Canada . |

*Primary Examiner*—Timothy V. Eley
*Assistant Examiner*—Dung Van Nguyen
*Attorney, Agent, or Firm*—Merchant & Gould P.C.

[57] ABSTRACT

A skate sharpening apparatus is disclosed having top surface (20) and a grinding disc (21) rotatable about a vertical axis above the surface. A bearing body (23, 28) having a free slide support (23) and a blocking section (28) is secured to the surface (20) slidably supports a guide bar (24). The blocking section (28) can be selectively fixed to or released from the guide bar. It is connected to the support (23) by an adjusting device moving the section (28) relative to the support (23) in fine increments. The front end (24*b*) of the guide bar (24) carries a pivot (34) supporting a lateral arm (35) for swinging about a horizontal swing axis (34*a*). The free end (36) of the lateral arm (35) carries a dressing tool (37, 37*a*) with rearwards directed dressing tip. The tool is slidable but can be fixed relative to the free end (36). The calibration of the desired radius of dressing the disc (21) is effected by abutting the dressing tip (38) against the disc (21) while the tip (38) coincides with the swing axis (34*a*) and then sliding the guide bar (24) by a distance corresponding to the desired radius and then fixing again the tool (37) to the free end (36). A digital or mechanical scale (27) at the support (23) is used in this adjustment. The invention presents an improved dressing tool where the measuring and adjusting elements are removed from the area where the debris released by the dressing might soil them. The caliration of the dressing radius is simpler than in previously known devices.

17 Claims, 3 Drawing Sheets

APPARATUS FOR DRESSING A GRINDING DISC

BACKGROUND OF THE INVENTION

1. Field of Invention

This invention relates to a dressing tool for use in a grinding apparatus provided with a grinding wheel mounted for rotation relative to a stationary base. In particular, the invention relates to a dressing tool adapted to dress the periphery of the grinding wheel to a predetermined radius.

It is often required, for instance in sharpening ice skate runners, to provide a grinding wheel the circumferential portion of which is tangential to the elongation of the runner. Since the elongated runners of skate blades have a concavely curved cross section, it is a requirement that the circumference of the grinding wheel have a correspondingly curved convex cross-section of a required radius.

In another aspect, the requirement may be for grinding with the circumferential surface of a grinding wheel a convexly rounded contour and in such case the grinding surface of the wheel must have a correspondingly concavely rounded contour.

2. Prior Art

A known ice skate sharpening apparatus with a dressing device for providing a desired convex curvature of the circumference of the grinding wheel has been in use in ice skate sharpening shops in North America for some time. It is shown, in a simplified diagrammatic fashion in FIGS. 1 and 2. The two drawings show, respectively, a partial top plan view and a partial side view.

The grinding wheel 1 is driven for rotation in a generally horizontal plane. The grinding device includes a flat, planar base or support table (not shown). Fixedly secured to a stationary cover of the grinding wheel 1 (the cover not shown) is a guide bar 2.

Slidable along the guide bar 2 is a bearing body 3 which is provided with a blocking screw 4. Thus, a selected position of the body 3 along the guide 2 can be fixed. The sliding movement of the body 3 is effected by means of a threaded drive rod 8 provided with a hand knob 9.

An oblique swing arm 11 is secured to the body 3 for swinging about an axis 12. The swinging is effected by manipulating the control knob 13. The end of the arm 11 remote from the body 3 is provided with a laterally angled end portion 14. There is a passage 15 provided in the end portion 14. The passage 15, is provided with a locking screw 5. Slidably received in the passage 15 is a diamond holding rod 6. The rod 6 slides in the direction of the arrow 16 which is parallel with direction 10, to selectively adjust the spacing of the diamond tip 7 from the axis 12. The gauge lines 18 include a centering mark 19. When the centring mark 19 matches the right-hand face of the end portion 14 as shown in FIG. 2, the diamond tip 7 is exactly in line with the pivot axis 12.

Assuming now that the grinding wheel 1 is to be dressed to a convexly shaped radius at its periphery, the size of the radius is determined by the gauge lines 18. The operator simply slides the rod 6 to the appropriate mark to establish the desired radius. If the desired radius is to be convex, the rod 6 and thus the tip 7 is displaced to the right of the position of FIG. 1. If the radius at the periphery of the grinding wheel is to be concave, the displacement of the tip 7 is to the left of the position of FIG. 1. When a proper radius is set, the locking screw 5 is tightened to lock the rod 6.

The hand knob 13 effects the swinging of the arm 11 and thus the end portion 14 about the axis 12, from the position shown in full lines of FIG. 2, to the position 7*a* which corresponds to the position shown in FIG. 1, and to the opposite side, to the position 7*b* which is about 180° from the initial position.

This movement causes the diamond tip 7 to circumscribe the desired radius about the axis 12.

With the screw 4 loose, the hand knob 9 is operated to bring the tip 7 to the wheel 1 to enable the dressing of same by swinging about the axis 12. When the dressing is finished, the rod 6 and the diamond is pivoted away from the periphery of the grinding wheel 1.

This known device has several disadvantages. First, since the pivot axis 12 is at an acute angle to the direction 16, the setup of the desired radius at the grinding wheel is relatively complex. Second, two sets of marks are required for proper operation: at the rod 6 and at the hand knob 9. Both marks are exposed to debris generated by the grinding. Thus the adjustment of the desired radius is complex and time consuming.

SUMMARY OF THE INVENTION

It is an object of the present invention to provide further advance in the art of the dressing tools mentioned above. In general terms, the invention provides In general terms, the invention provides an apparatus for dressing a peripheral portion of a grinding disc. The apparatus comprises a bearing body including a free slide support and a blocking section, said bearing body slidably receiving a guide bar for sliding of the guide bar along a longitudinal axis. An adjusting device is operatively associated with said bearing body and with said guide bar to selectively adjust longitudinal position of the guide bar relative to the slide support by fine increments in the range of accuracy of about ten thousandths of an inch or more. A lateral arm is pivotably secured to a front end portion of said bar by a pivot for swinging the arm about a swing axis generally perpendicular said longitudinal axis. A free end portion of the lateral arm remote from said pivot supports a dressing tool including a dressing tip at a location laterally spaced from said longitudinal axis. A dressing radius calibrating means is operatively associated with said free end portion for selectively adjusting and fixing the distance of the dressing tip from said swing axis to calibrate the radius circumscribed by said dressing tip at the circumference of an associated grinding disc.

More specifically but still defining the invention in general terms, a skate sharpening apparatus is provided, comprising a base having a horizontal, generally planar top surface. The base supports a grinding disc assembly including a grinding disc rotatable about a vertical axis and spaced above said top surface. A bearing body is fixedly secured to said planar top surface and slidably receives a guide bar for sliding therein along a generally horizontal longitudinal axis. The bearing body is comprised of a free slide support section and a guide bar blocking section. The bearing body further includes an adjusting device adapted to selectively adjust, by fine increments, the position of the guide bar along said longitudinal axis. The guide bar is provided, at a front end thereof, with a pivot supporting a lateral arm for swinging about a generally horizontal swing axis generally coplanar with the plane of rotation of said grinding disc and perpendicular to said longitudinal axis. The lateral arm has a free end portion remote from said swing axis, and so arranged that the swing axis is located between said free end portion and said front end of the guide bar. The free end portion supporting a dressing rod has a dressing tip at a location laterally spaced from said longitudinal axis and pointing toward said swing axis. The appartus further includes dressing radius calibrating means for selectively adjusting the distance of the dressing tip from said swing axis to calibrate the size of radius circumscribed by said dressing tip at the periphery of said grinding disc on swinging of the lateral arm. Dressing engagement control means is provided for displacing said pivot axis by predetermined fine increments in a direction parallel with said longitudinal axis toward or away from the vertical axis of rotation of the grinding disc.

BRIEF DESCRIPTION OF THE DRAWINGS

Exemplary embodiments of the invention will now be described by way of an ice skate sharpening device, with reference to the accompanying diagrammatic, not-to-scale drawings. In the drawings.

DETAILED DESCRIPTION

Figures 1, 2:
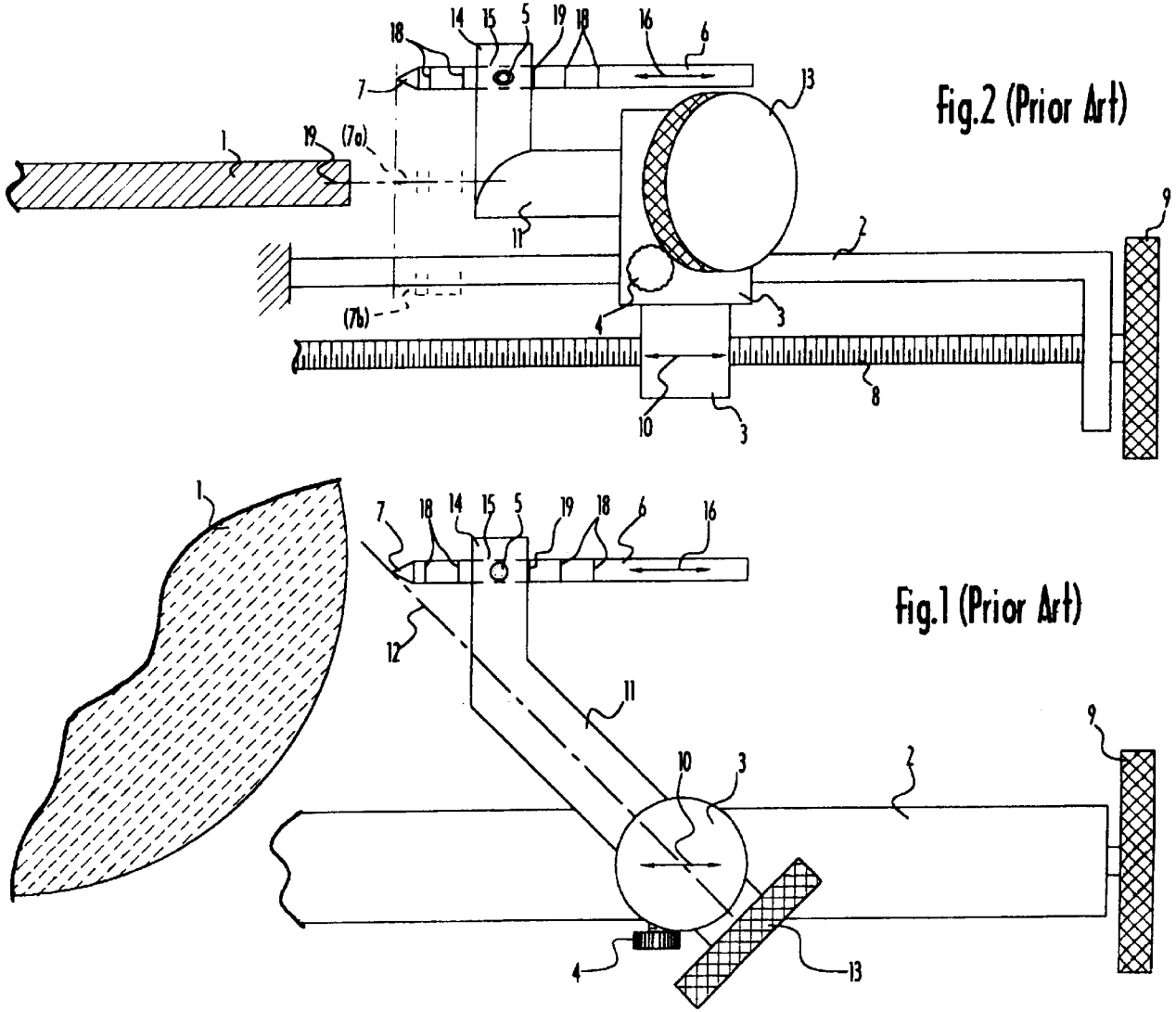
Fig.2 (Prior Art)
Fig.1 (Prior Art)
FIG. 1 is a diagrammatic top plan view of the dressing device of prior art.
FIG. 2 is a side view thereof.
Figure 4:
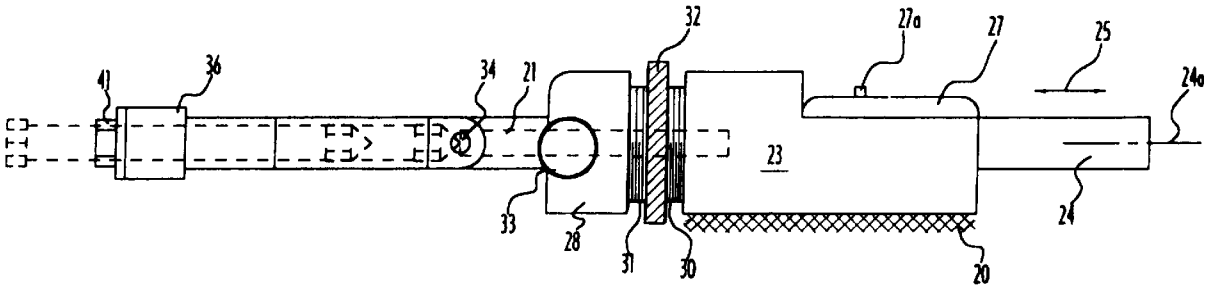
FIG. 4 is a side view thereof, taken from the bottom of the representation of FIG. 3.
Figure 3:
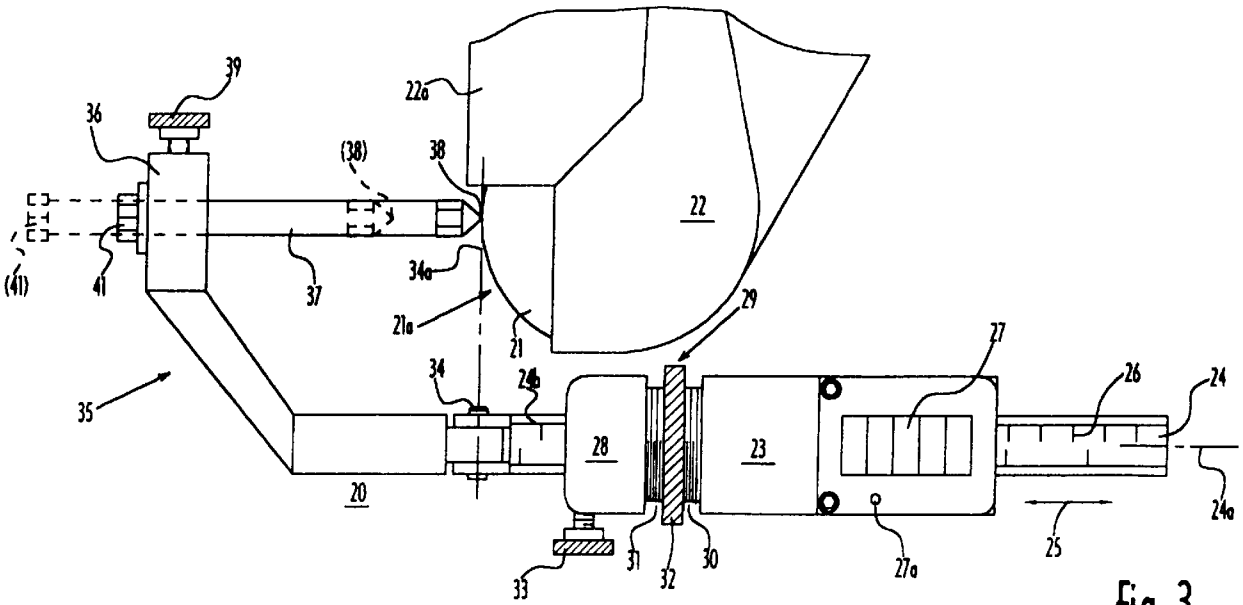
FIG. 3 is a top plan view of an exemplary embodiment of an ice skate sharpening apparatus including the present invention.
Figure 6:
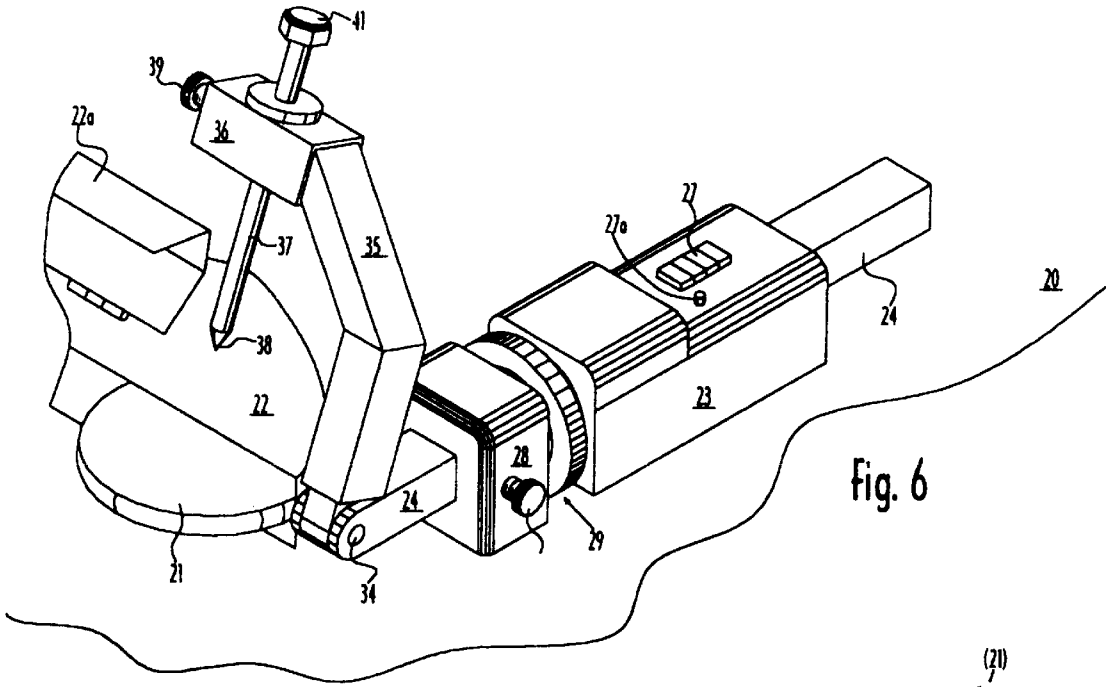
FIG. 6 is a perspective view of the the skate sharpener with the device of the invention in a folded position, after the dressing is done and the sharpener is ready for operation.

The device of the present invention is shown, in FIGS. 3, 4, 6 as being attached to a skate sharpening machine. The machine is provided with a stationary, generally planar table 20. Mounted to the table 20 is a grinding wheel 21 a major part of which is surrounded by a cover 22. The cover 22 includes a hinged section 22*a* which is in a closed position (FIG. 3), during the dressing of the disc 21, and is open (FIG. 6) when the apparatus is operative in sharpening an ice skate. The wheel 21 rotates in a generally horizontal plane parallel with the surface of the table 20.

Fixedly secured to the table 20 is a bearing body including a slide support 23 in which freely longitudinally slides a guide bar 24 in the direction 25. The guide bar 24 is provided with a series of marks 26. A digital display device 27 on the slide support 23 includes a reset button 27*a*. In the embodiment shown, the digital display device 27 was taken from a regular calliper. Since such devices are well know in the art of measuring, the display device 27 is not described in greater detail. It may, of course, be substituted by another known system, e.g. by a vernier or the like. The instant longitudinal position of the guide bar 24 relative to the body 23 can be accurately established at any time.

A blocking section 28 of the bearing body 23, 28, is connected to one end of the support 23 by way of an adjustment device 29. In the embodiment shown, the adjustment device is an integrally formed unit having two opposed threaded end portions 30, 31. A control member 32 is disposed at the centre of the adjustment device 29. One of the threaded end portions has a right-hand thread, the other a left-hand thread. The end portions 30, 31 are threadably received in appropriately arranged openings in the blocking section 28 and in the slide support 23. The blocking section 28 has a longitudinal passage similar to the passage in the support 23 so that the guide bar 24 slidably passes through the support 23 and the blocking section 28. The blocking section 28 is provided with a blocking screw 33 which serves the purpose of selectively blocking the movement of the guide bar 24.

The front end portion 24*b* of the bar 24 projects from the blocking section 28 carries a pivot pin 34 defining a pivot axis 34*a* perpendicular to the axis 24*a* of the bar 24. The axis 34*a* is generally parallel with the plane of rotation of the grinding wheel 21. Since the grinding wheel in the skate sharpener shown is normally rotated in a horizontal plane, the axis 34*a* is also horizontal.

The pivot pin 34 provides a pivotal link between the guide bar 24 and a lateral swinging arm 35 extending laterally away from the axis 24*a* of the guide bar 24. The free end portion 36 of the lateral arm 35 has a passage which slidably receives a support rod 37 carrying a diamond point or tip 38 and extending at right angles to the axis of the pivot pin 34. The rod 37, the end portion 36 and the tip 38 define what is generally referred to as a dressing tool. A stop screw 39 extends into the passage in the portion 36 to permit the locking of the rod 37 at a predetermined position. The items 36, 37, 39 thus present a preferred embodiment of dressing radius calibrating means.

The embodiment of the rod 37 shown in FIGS. 3 and 4 is intended where only a convex curvature of the circumference of the grinding disc is required such as in ice skate sharpening machines. The dressing tip 38 of the rod 37 is located on the axis 34*a* when the shoulder of the head 41 abuts the free end portion 36. This provides stop means which prevents the movement of the tip 38 beyond the axis 34*a*. The rod 37 can only be moved to the left of the axis 34*a* in FIG. 3, where the swing of the lateral arm 35 about the pivot 34 can only result in the tip circumscribing a convex dressing radius on the circumference of the grinding wheel 21.

Figure 5:
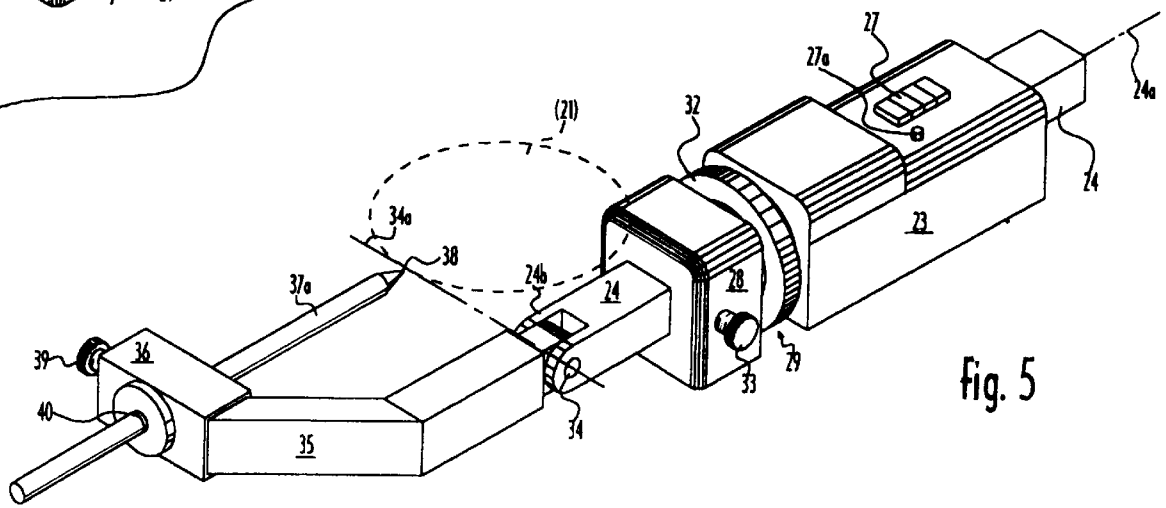
FIG. 5 is a perspective view of the device of the present invention shown alone, without being attached to the support of a sharpening device.

On the other hand, the rod 37*a* shown in FIG. 5 is intended for use where it may be desired to dress the grinding disc either to a convex or a concave shape. This is accomplished by simply making the rod 37*a* longer and providing it with a zero mark 40 or some other indicating or stop means co-operating with the free end portion 36, to mark the placement of the tip 38 on the axis 34*a* of pivot 34. Thus, in this second embodiment, the tip 38 can be displaced to either side of the pivot axis 34*a*. In a position to the left of axis 34*a* in FIG. 5, the radius dressed by swinging the arm 35 about the axis 34*a* is convex, in a position to the right of the axis 34*a*, the dressed radius is concave.

Those skilled in the art will readily appreciate that a vast number of different means for locating the tip 38 on the axis 34*a* may exist, ranging from the two embodiments shown, to supplying the device of the present invention with special stop or arrest means or even several different lengths of the rod 37.

What is important is that the length and disposition of the rod 37 or 37*a* be sufficient to permit movement of the tip 38 away from the axis 34*a* by a distance corresponding at least to the maximum radius required in operation of the dressing device.

The releasable blocking screw 39 serves the purpose of locking the position of the rod 37 or 37*a* upon securement of the desired operative distance of the tip 38 from the axis 34*a*.

The operation of the invention will now be described. The sliding support 23 is fixedly secured to the support table 20 at a location remote from the exposed section 21 a of the grinding disc 21. This may be done either by the manufacturer of a new sharpening device or by a user upgrading an existing sharpener.

The rod 37 or 37*a* is placed in a "zero" position, i.e. aligned with the pivot axis 34*a*. The blocking screw 33 is loose permitting a free sliding of the guide bar 24 through the bearing 23 and the blocking member 28. With the blocking screw 39 also released and the arm 35 manually held in a position where the tip 38 faces the circumference of the wheel 21, the guide bar 24 is slid through the bearing body 23, 28 to the right of FIG. 3 until the tip 38 touches the circumference of the wheel 21 as shown in full lines of FIG. 3.

At this position, the reset button 27*a* is activated to bring the digital display to a zero value. If a mechanical device is provided such as a vernier, the indicated value of the scale is simply noted.

Assuming now, for instance, that the desired radius at the periphery of the wheel 21 is 2 inches, the guide bar 24 is moved further to the right of FIG. 3 by a distance of 2 inches, using the digital display or whatever measuring system is used. Since the blocking screw 39 is loose, the displacement results in an equal displacement at the rod 37, 37*a* relative to the free end portion 36 (broken lines in FIG. 3). Thus, the display 27 or its equivalent now shows the magnitude of the radius circumscribed by the tip 38.

The blocking screw 39 is now tightened, whereby the dressing radius is secured regardless of further changes of the position of the arm 35 or guide bar 24. In other words, the sliding of the bar 24 through the bearing body 23, 28 does not change the dressing radius.

Subsequently, the bar 24 is slid to the left of FIG. 3 to move the tip 38 away from the circumference of the wheel 21, whereupon the drive of the wheel 21 is started. The diamond tip 38 is now brought back into a light contact with the circumference of the rotating wheel 21 by careful sliding of the bar 24 to the right of FIG. 3.

Once the slight contact of the diamond tip 38 with the wheel 21 is observed, the blocking screw 33 is of the blocking section 28 is tightened. The initial position of the dressing diamond 38 is now established.

Swinging of the arm 35 makes the tip 38 move about the periphery of the wheel 21 at the preset radius. The arm 35 (and thus the tip 38) can be brought to a further dressing position by a fine increment accomplished by rotating the collar 32 in a desired direction, over a pre-determined angle of rotation of the collar 32. Since the blocking screw 33 is now tightened, the turning of the collar 32 results in sliding of the bar 24 through the support 23 by finely controlled increments, e.g. of a magnitude of about 10 thousands of an inch, to compensate for the reduction of the active circumference of the wheel 21 due to the dressing action or the wear of the wheel in sharpening the workpiece.

When the dressing is finished, the arm 35 is simply brought to a folded position shown in FIG. 6. The dressing tool remains ready for an accurate subsequent dressing by simply swinging the arm 36 from the position of FIG. 6 back to that of FIG. 3 or 4 with an appropriate further fine adjustment by turning of the collar 32.

Those skilled in the art will readily appreciate that many components of the present invention can be replaced by obvious equivalents. Strictly as a few examples, the "zero" position of the diamond supporting rod 37 can be achieved by a vast number of different designs, for instance by placing a removable stop onto the rod 37*a* to one or to the other side of the free end portion 36 depending on the desired configuration of the dressing swing of the diamond 38.

The calibration means described may also differ from the embodiments shown, without departing from the present invention. For instance, the calibration may be effected at the rod supporting the dressing tip by making the rod a threaded rod having a predetermined pitch.

The screw head 41 presents only one embodiment of a vast number of other stop means for the same purpose, as already mentioned.

The blocking or arresting means 33, 39 do not necessarily have to be blocking screws but can be substituted by other known devices, for instance a ratchet mechanism. The fine adjustment of longitudinal position presently achieved by the adjustment device 29, can be substituted by a great number of different means, for instance a combination of a spring and set screw. It is also obvious that the present invention is useful for dressing the grinding disc regardless of the position of the axis of rotation of the disc.

If the disc rotates about a horizontal axis, then the swing axis 34*a*, of course would have to be vertical and not horizontal as in the embodiments shown. In the dressing position shown in FIG. 3, the dressing tip 38 points toward the centre of rotation of the disc 21. While such arrangement is preferred, minor deviations from such a position may be effected.

These and other departures from the embodiments described do not depart from the present invention as defined in the accompanying claims. Therefore, the meaning of "means" disclosed in the description are indicative of the availability of obvious modifications which are intended to be included in the scope of the claims.

I claim:

1. Apparatus for dressing a peripheral portion of a grinding disc comprising, in combination:

(a) a bearing body including a free slide support and a blocking section, said bearing body slidably receiving a guide bar for sliding of the guide bar along a longitudinal axis;

(b) an adjusting device operatively associated with said bearing body and with said guide bar to selectively adjust longitudinal position of the guide bar relative to the slide support by fine increments in the range of accuracy of about ten thousandths of an inch or more;

(c) a lateral arm pivotably secured to a front end portion of said bar by a pivot for swinging the arm about a swing axis generally perpendicular said longitudinal axis;

(d) a free end portion of the lateral arm remote from said pivot supporting a dressing tool including a dressing tip at a location laterally spaced from said longitudinal axis;

(e) dressing radius calibrating means operatively associated with said free end portion for selectively adjusting and fixing the distance of the dressing tip from said swing axis to calibrate the radius circumscribed by said dressing tip at the circumference of an associated grinding disc.

2. The apparatus of claim 1, wherein said bearing body includes measurement display device indicating instant position of the guide bar relative to the slide support.

3. The apparatus of claim 2, wherein the display device is a digital display device.

4. The apparatus of claim 3, wherein the display device includes a reset device adapted to bring the display of the digital display of the device to a zero value.

5. The apparatus of claim 1, wherein said blocking section is provided with a blocking screw adapted to fixedly but releasably secure said blocking section and the guide bar to each other.

6. The apparatus of claim 5, wherein said adjusting device includes two coaxial, opposed threaded end portions comprised of a right-hand threaded first portion and a left-hand threaded second portion, said threaded portions being received one in said blocking section and the other in said free slide support, said adjusting device further including a control member for simultaneously turning said first and second portions to thus adjust the distance between said slide support and said blocking section and thus to adjust the longitudinal position of the guide bar relative to the slide support when the guide bar is fixedly secured by said blocking screw to the blocking section.

7. The apparatus of claim 6, wherein said threaded first and second portions are co-axial with the longitudinal axis and the adjusting device is hollow to allow free passage of said guide bar therethrough.

8. The apparatus of claim 1, wherein said free end portion of the lateral arm, viewed from said guide bar, is disposed beyond said swing axis and wherein said dressing tip points in a direction from said free end portion to said swing axis.

9. The apparatus of claim 8, wherein said dressing radius calibrating means includes a rod supporting, at one end thereof, said dressing tip, said rod being slidable in said free end portion, said calibrating means including a stop abutting the free end portion when the dressing tip is aligned with said swing axis.

10. The apparatus of claim 9, further including a stop screw for fixedly retaining the supporting rod in the free end portion when the dressing point is at a predetermined distance from the swing axis whereby a set radius circumscribed by the dressing point transversely of the periphery of a grinding disc is maintained.

11. A skate sharpening apparatus comprising:

(a) a base having a horizontal, generally planar top surface;

(b) said base supporting a grinding disc assembly including a grinding disc rotatable about a vertical axis and spaced above said top surface;

(c) a bearing body fixedly secured to said planar top surface and slidably receiving a guide bar for sliding therein along a generally horizontal longitudinal axis;

(d) said bearing body being comprised of a free slide support section and a guide bar blocking section;

(e) said bearing body further including an adjusting device adapted to selectively adjust, by fine increments, the position of the guide bar along said longitudinal axis;

(f) said guide bar being provided, at a front end thereof, with a pivot supporting a lateral arm for swinging about a generally horizontal swing axis generally coplanar with the plane of rotation of said grinding disc and perpendicular to said longitudinal axis;

(g) said lateral arm having a free end portion remote from said swing axis, and so arranged that the swing axis is located between said free end portion and said front end of the guide bar;

(h) the free end portion supporting a dressing rod having a dressing tip at a location laterally spaced from said longitudinal axis and pointing toward said swing axis;

(i) dressing radius calibrating means for selectively adjusting the distance of the dressing tip from said swing axis to calibrate the size of radius circumscribed by said dressing tip at the periphery of said grinding disc on swinging of the lateral arm; and (j) dressing engagement control means for displacing said pivot axis by predetermined fine increments in a direction parallel with said longitudinal axis toward or away from the vertical axis of rotation of the grinding disc.

12. Apparatus of claim 11, wherein the dressing engagement control means is said adjusting device.

13. The apparatus of claim 12, wherein the free slide support section of the bearing body is fixedly secured to the base, while the blocking section is selectively displaceable relative to the free slide support section, the blocking section including a blocking screw for a releasably fixed securement of the blocking section to the guide bar.

14. The apparatus of claim 13, wherein said adjusting device is adapted to displace the blocking section relative to the free slide support section by said fine increments, whereby, with the blocking section fixed to the guide bar, the adjusting device displaces the swing axis by said fine increments.

15. The apparatus of claim 14, wherein said adjusting device includes two opposed coaxial threaded end portion comprised of a right-hand threaded end portion and a left-hand threaded end portion, said end portions being threadably received one in said blocking section and the other in said free slide support, said adjusting device further including a control member for turning said adjusting device to thus adjust the distance between said slide support and said blocking section to adjust the longitudinal position of the guide bar relative to the slide support by said fine increments when the guide bar is fixedly secured by said blocking screw to the blocking section.

16. The apparatus of claim 11, wherein said calibrating means includes (a) a selectively fixable sliding engagement of said dressing rod to the free end portion of the lateral arm, and (b) a measurement display device on said bearing body indicating instant position of the guide bar relative to the slide support;

whereby the dressing radius is adjusted by modifying instant position of the guide bar relative to the slide support while maintaining a free sliding engagement between the dressing rod and said free end portion, with the dressing tip abutting the periphery of the grinding disc.

17. The apparatus of claim 11, wherein said dressing rod is provided with stop means adapted to abut the free end portion at a position where the dressing tip is on said swing axis, whereby the displacement of the dressing rod in the direction away from the free end portion and beyond the swing axis is prevented.

* * * * *